US007134209B1

(12) United States Patent
Molenaar

(10) Patent No.: US 7,134,209 B1
(45) Date of Patent: Nov. 14, 2006

(54) DISC CUTTER

(76) Inventor: Steven L. Molenaar, 601 W. Hwy. 40, Willmar, MN (US) 56201

( * ) Notice: Subject to any disclaimer, the term of this patent is extended or adjusted under 35 U.S.C. 154(b) by 0 days.

(21) Appl. No.: 11/134,162

(22) Filed: May 23, 2005

(51) Int. Cl.
*B26D 1/143* (2006.01)
*B26D 1/14* (2006.01)
*B26B 29/00* (2006.01)

(52) U.S. Cl. ..... 30/319; 30/307; 30/329; 30/334; D7/383; D7/694; 83/698.42; 403/94

(58) Field of Classification Search ..... 30/319, 30/334, 142, 329, 307, 306, 43.92, 390, 391; 280/11.221, 11.223, 269, 270; D8/98, 20, D8/70; D7/694, 383; 451/251, 258, 290; 403/55, 80, 94, 116, 168, 223, 232.1, 242, 403/243, 244, 305, 384, 397, 399, 385; 83/698.41, 83/698.42, 478; 446/465, 469, 20, 70, 440, 446/471

See application file for complete search history.

(56) References Cited

U.S. PATENT DOCUMENTS

| | | | | | |
|---|---|---|---|---|---|
| D159,723 | S | * | 8/1950 | Glade | D8/70 |
| 2,568,374 | A | * | 9/1951 | Islyn | 446/440 |
| 3,682,027 | A | | 8/1972 | Insolio et al. | |
| 4,098,156 | A | | 7/1978 | Insolio | |
| 4,423,551 | A | * | 1/1984 | Chmela et al. | 30/142 |
| 4,892,022 | A | * | 1/1990 | Cotton et al. | 83/478 |
| 5,428,898 | A | * | 7/1995 | Hawkins | 30/295 |
| 5,480,031 | A | * | 1/1996 | Maultasch et al. | 206/525 |
| D375,662 | S | * | 11/1996 | Noga | D7/694 |
| D392,162 | S | * | 3/1998 | Henry et al. | D7/694 |
| D397,001 | S | * | 8/1998 | Antista et al. | D7/694 |
| 5,933,918 | A | * | 8/1999 | Wallays | 16/114.1 |
| 6,406,038 | B1 | * | 6/2002 | Adams | 280/11.24 |
| 6,438,850 | B1 | | 8/2002 | Young et al. | |
| 6,484,407 | B1 | * | 11/2002 | Khatchadourian et al. | 30/319 |
| 6,572,461 | B1 | * | 6/2003 | Guldi et al. | 451/259 |
| 6,739,602 | B1 | * | 5/2004 | Adams | 280/11.19 |
| D494,823 | S | * | 8/2004 | Overthun et al. | D8/20 |
| 2005/0028388 | A1 | * | 2/2005 | Liu | 30/319 |

FOREIGN PATENT DOCUMENTS

| | | | | |
|---|---|---|---|---|
| DE | 125238 | * | 11/1901 | 30/307 |

* cited by examiner

*Primary Examiner*—Boyer D. Ashley
*Assistant Examiner*—Edward Landrum

(57) ABSTRACT

A pizza cutter has a hollow semi-circular shaped handle having a convex curved radiused top edge to facilitate use and reduce hand stress. A removable cutter wheel has outwardly extending axles having protrusions on the outer ends thereof that have a snap fit relationship with recesses on the inner surfaces of the handle whereby the cutter wheel can easily be snapped into and out of the handle for cleaning. The cutter wheel has a dual inner and outer axle assembly engaging complementary shaped bearing surfaces on the handle to distribute pressure exerted on the wheel and keep the cutter wheel aligned with the handle when cutting movement is applied to the cutter.

8 Claims, 6 Drawing Sheets

DISC CUTTER

FIELD OF THE INVENTION

The invention is directed to a disc cutting kitchen utensil for cutting and processing food such as pizza, and the like, particularly ergonomic cutters with quick release blades.

BACKGROUND OF THE INVENTION

Pizza cutter tools with cutting wheels commonly have an elongated stick-shaped handle with a non-removable wheel. These prior cutting utensils are known to have relatively unstable and unreliable cutting action and can be difficult to properly clean.

SUMMARY OF THE INVENTION

The invention comprises a food processing cutting utensil having a housing with resiliently flexible side walls joined to a semi-circular shaped top wall. A cutter disc is releasably mounted in the housing. The disc has outwardly directed axles which are joined to the center of the disc. The axles are rotatably located in grooves on the housing to rotatably mount the disc on the housing. The disc extends through a slot in the bottom of the housing to expose a cutting edge useable to process and cut food, such as pizza.

DESCRIPTION OF PREFERRED EMBODIMENT

Figure 1:
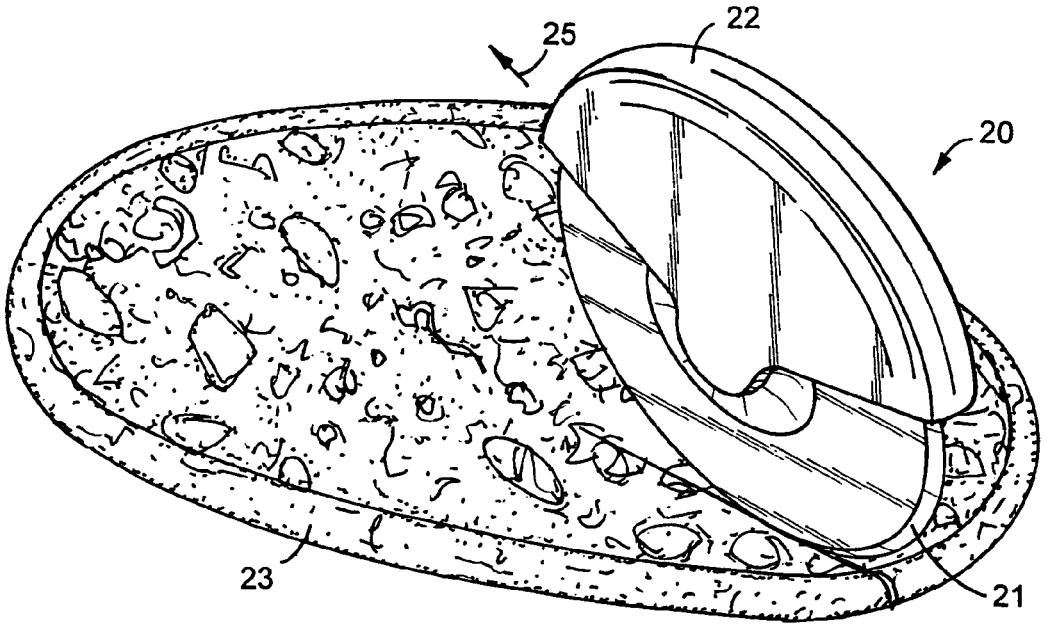
FIG. 1 is a perspective view of the disc cutter of the invention shown cutting a pizza.
Figure 2:
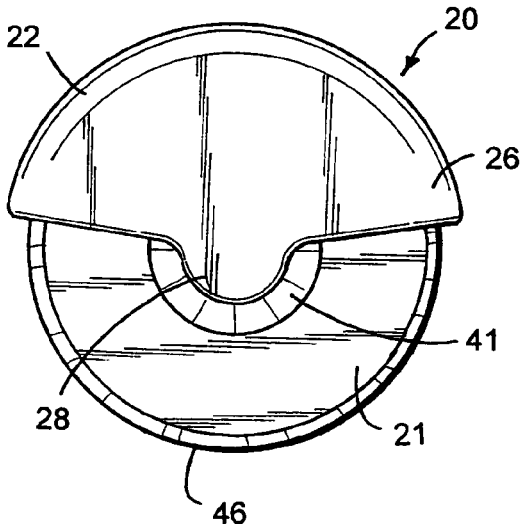
FIG. 2 is a front elevational view of the disc cutter of FIG. 1.
Figure 3:
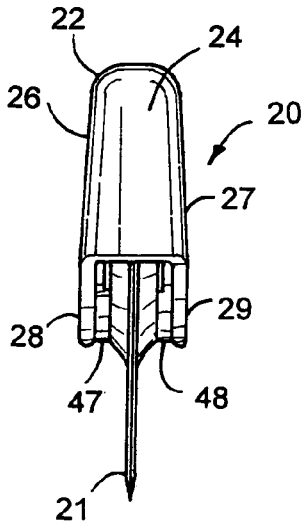
FIG. 3 is a side elevational view of the right side of the disc cutter FIG. 1.
Figure 4:
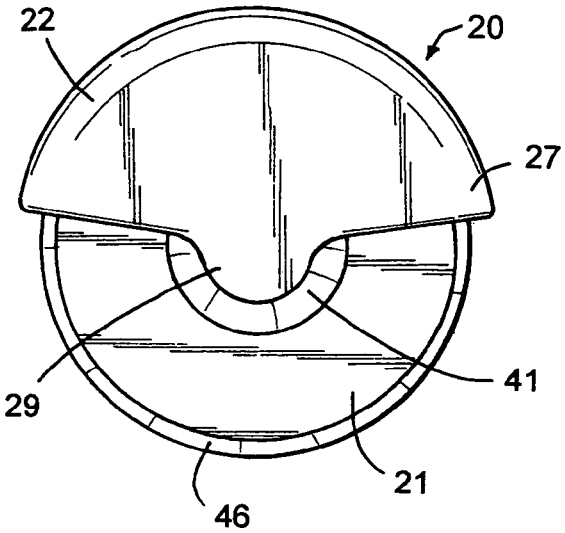
FIG. 4 is a back elevational view of the disc cutter of FIG. 1.
Figure 5:
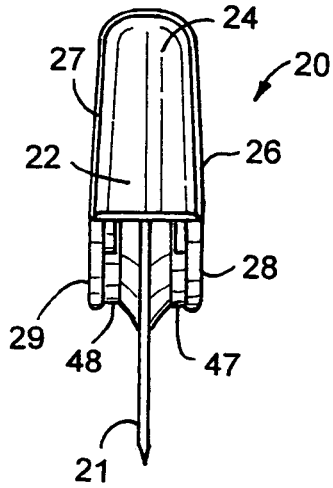
FIG. 5 is a side elevational view of the left side of the disc cutter of FIG. 1.
Figure 6:
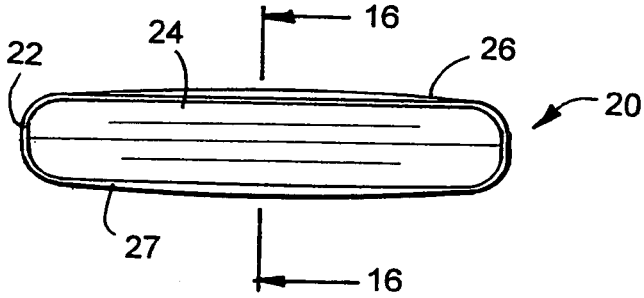
FIG. 6 is a top plan view of the disc cutter of FIG. 1.
Figure 7:
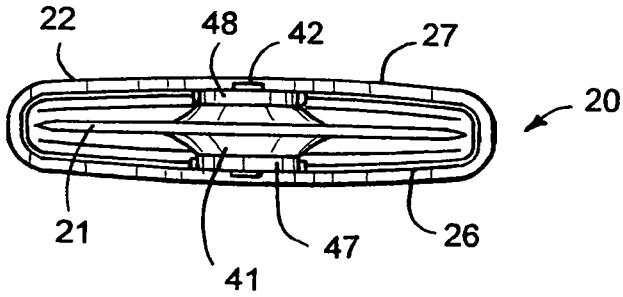
FIG. 7 is a bottom plan view of the disc cutter of FIG. 1.
Figure 8:
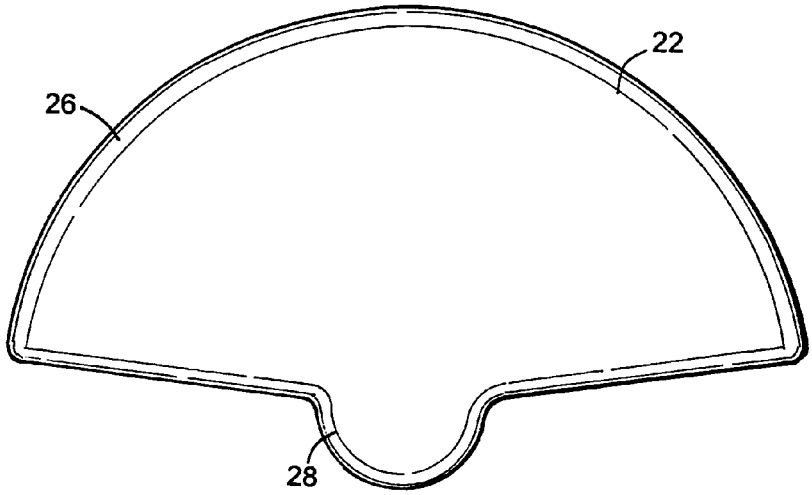
FIG. 8 is a front elevational view of the handle of the disc cutter of FIG. 1.
Figure 9:
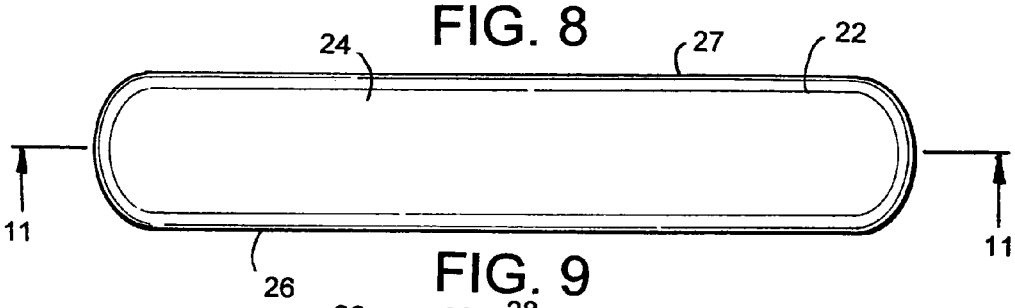
FIG. 9 is a top plan view of FIG. 8.

Referring to FIGS. 1 to 7, there is shown a disc cutter assembly, indicated generally at 20, useable as a food processing and cutting utensil for slicing pizza 23 or chopping and cutting flat breads, pastries, raisins, apples, spices, herbs and the like. Cutter 20 has a handle 22 and a removable disc cutter or cutting wheel 21 releasably mounted on handle 22. Cutting wheel 21 is a generally flat one-piece circular plastic member having a relatively sharp annular cutting edge 46. Cutting wheel 21 can be made from other materials such as metal, and have other types of cutting edges such as a fluted cutting edge (not shown) for cutting pastries.

Handle 22 is a hollow molded plastic semi-circular shaped housing member having semi-rigid semi-circular shaped side walls 26 and 27 joined to an arcuate concave curved semi-circular top wall 24. Side walls 26 and 27 can be expanded and slightly flexed outwardly and moved apart to allow cutting wheel 21 to be moved into and out of a locking position in handle 22 and separated there from. When cutting wheel 21 is moved into and located in the locking position, side walls 26 and 27 recover their shape. Top wall 24 has an ergonomic radiused convex curved edge to facilitate use of cutter 20 by dissipating and reducing stress to the hand. Each of the bottom edges of side walls 26 and 27 are generally arcuate having a downwardly extended semi-circular shaped gripping area or ear 28, 29 for the thumb and finger tips at approximately the middle portion of the bottom edge. Ears 28 and 29 are located on opposite sides of handle 22 adjacent the center or axis of cutting wheel 21. When ears 28 and 29 are gripped between the thumb and finger tips, top wall 24 is located in the palm of the hand whereby a relatively large downward pressure can be exerted directly on cutting wheel 21 generally perpendicular to the cutting surface while substantial control of the cutting action is maintained.

Referring to FIGS. 8 to 11, handle 22 has an inwardly directed slot 30 for accommodating cutting wheel 21. Slot 30 is formed in the bottom of handle 22 and extends upwardly to top wall 24. Cutting wheel 21 extends through slot 30 exposing edge 46. Slot 30 extends transversely generally in the plane of cutting wheel 21 whereby handle 22 overlies cutting wheel 21 to prevent injury to the hand and fingers while providing means for applying cutting downward pressure on cutting wheel 21.

Figure 10:
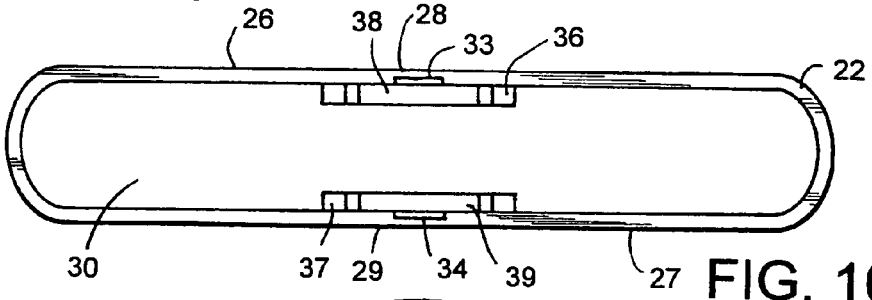
FIG. 10 is a bottom plan view of FIG. 8.
Figure 11:
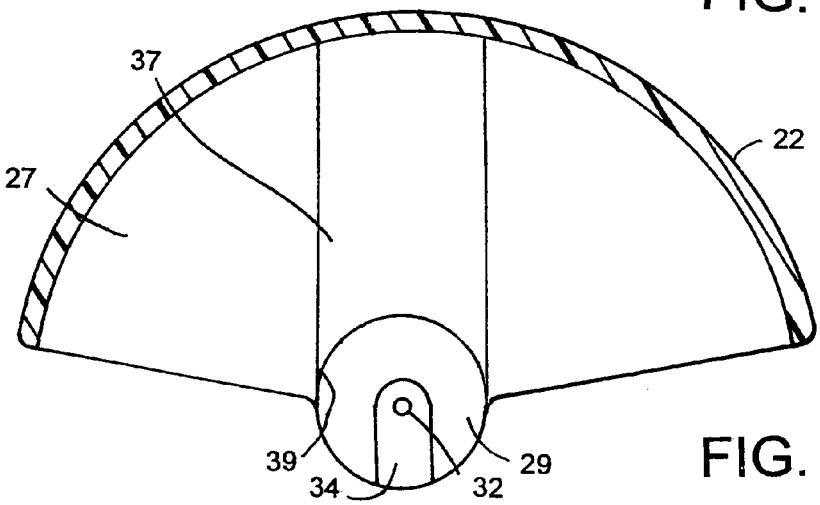
FIG. 11 is a sectional view taken along line 11—11 of FIG. 9.

As seen in FIGS. 10 and 11, the inside surfaces of side walls 26 and 27 each have a rectangular shaped tab 36, 37 that inclines downwardly and inwardly into slot 30. The bottom portion of each tab 36, 37 terminates in an arcuate shoulder 38, 39 having a downwardly directed semi-circular bearing surface. The outer radial surfaces of collars 47 and 48 are located adjacent to and have a complementary shape relative to shoulders 38 and 39 thereby slidably engaging shoulders 38 and 39. The outer ends of collars 47 and 48 engage the inside surfaces of ears 28 and 29 generally normal to the engagement of the outer radial surfaces of collars 47 and 48 with shoulders 38 and 39. Longitudinal grooves 33 and 34 on the inside surfaces of ears 28 and 29 located below shoulders 38 and 39 are open to the bottom of ears 28 and 29. The upper ends of grooves 33 and 34 are closed and have downwardly directed semi-circular bearing surfaces which are parallel to semi-circular bearing surfaces of shoulders 38 and 39. The arcuate bearing surfaces at the upper ends of grooves 33 and 34 accommodate the ends of axles 42 and 44. Semi-spherical concave curved recess 31 and 32 are located in the upper ends of grooves 33 and 34. Recesses 31 and 32 are radially spaced from the upper ends and sides of grooves 33 and 34. Recesses 31 and 32 accommodate semi-spherical convex curved projections or protrusions 43 and 45 on the outer ends of axles 42 and 44 in a snap fit or friction fit relationship.

Figure 12:
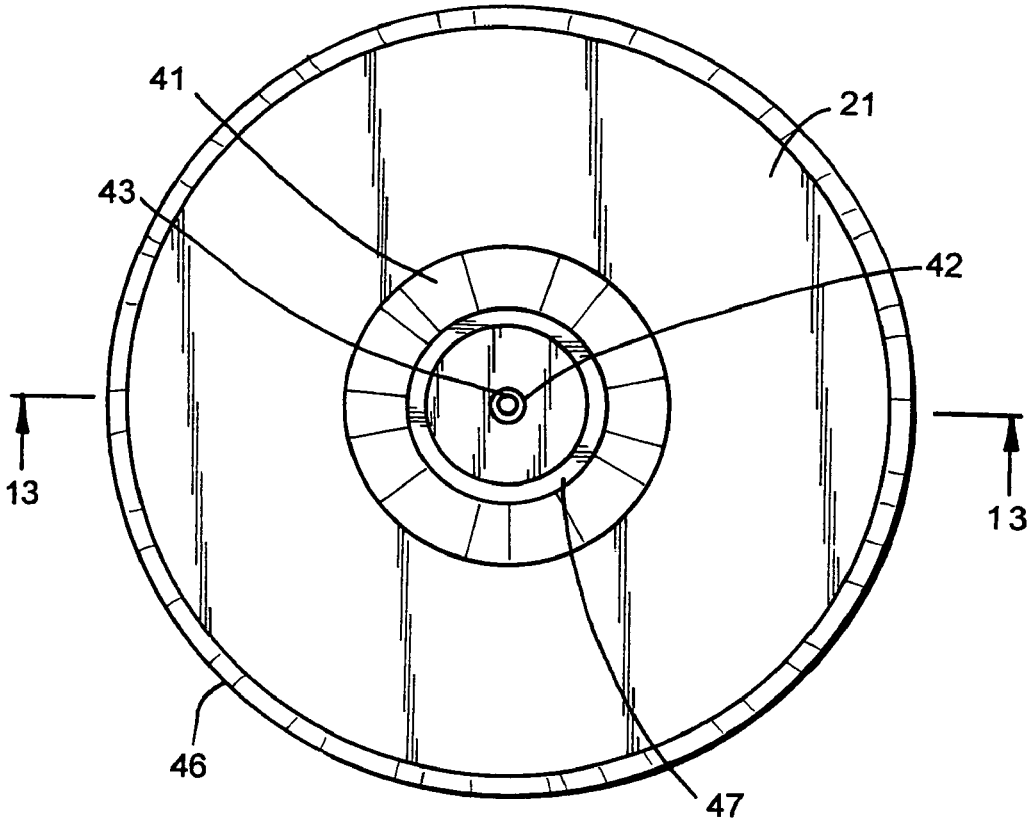
FIG. 12 is a front elevational view of the cutting wheel of the disc cutter of FIG. 1.
Figure 13:
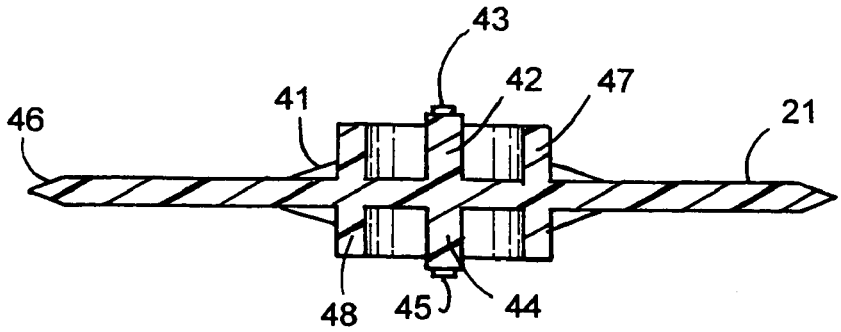
FIG. 13 is a sectional view taken along line 13—13 of FIG. 12.

As seen in FIGS. 12 and 13, cutting wheel 21 has a centrally located hub 41 having a pair of annular axles or collars 47 and 48 extending in opposite transverse directions from the center of hub 41. Axles 42 and 44 are cylindrical shafts joined to the center of wheel 21 on opposite side thereof and extend in opposite directions there from. The ends of axles 42 and 44 are rotatably located in the upper ends of grooves 33 and 34. Collars 47 and 48 extend from the outer side surfaces of cutting wheel 21 and surround axles 42 and 44. The outer ends of collars 47 and 48 are spaced inwardly from and proximally located relative to the outer ends of axles 42 and 44. Axles 42 and 44 and collars 47 and 48 have a common axis forming a dual inner and outer axle assembly to maximize pressure distribution and stabilization of cutting wheel 21. The outer radial surfaces of collars 47 and 48 slideably engage shoulders 37 and 38 to allow cutting wheel 21 to rotate and prevent wheel 21 from being pushing further into slot 30. The outer transverse ends of collars 47 and 48 bear against the inside surfaces of ears 28 and 29. The combined sliding engagement of collars 47 and 48 with shoulders 37 and 38, axles 42 and 44 with grooves 33 and 34, and the friction fit relationship of protrusions 43 and 45 and recesses 31 and 32 stabilize cutting wheel 21 to minimize wobbling and uncontrolled cutting when cutter 20 is pressed into and moved across pizza 23, as shown by arrow 25 in FIG. 1. This also reduces galling and premature wearing of the bearing surfaces extending the life of cutter 20.

Figure 14:
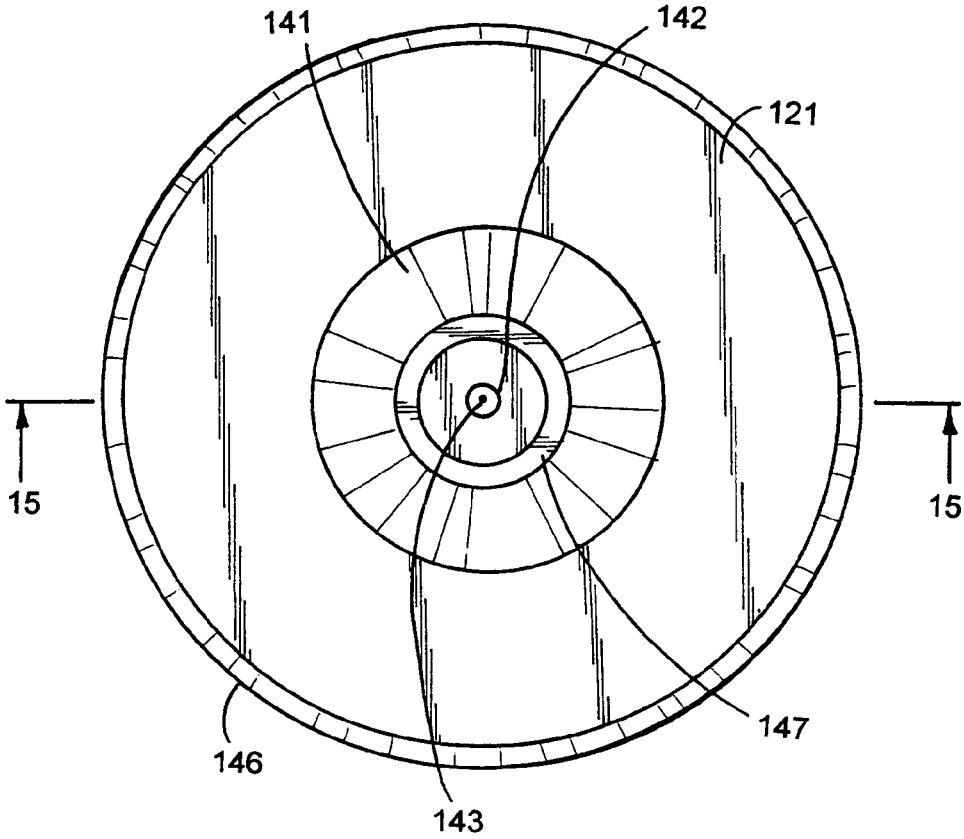
FIG. 14 is a front elevational view of a modification of the cutting wheel of FIG. 12.
Figure 15:
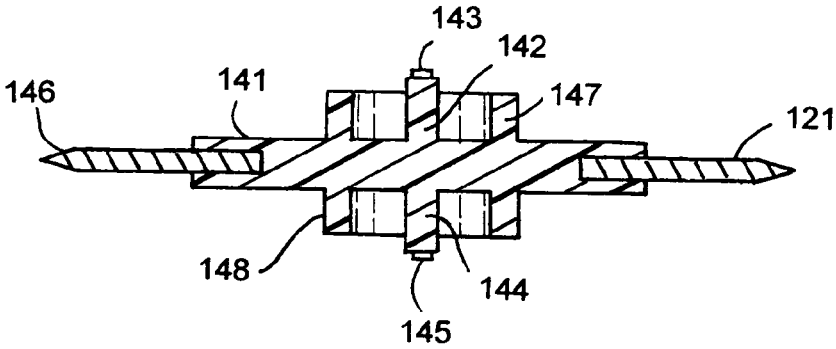
FIG. 15 is sectional view taken along line 15—15 of FIG. 14.
Figure 16:
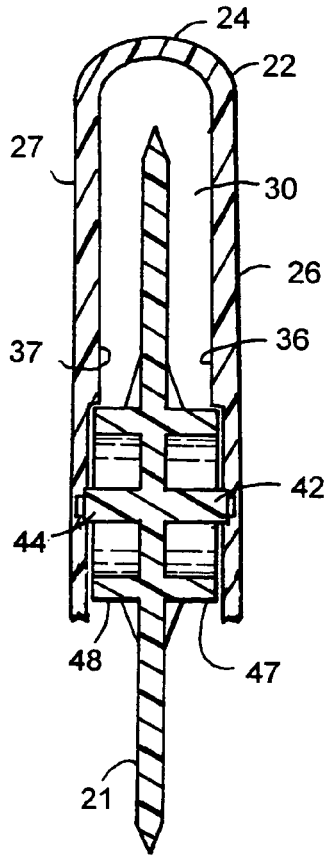
FIG. 16 is an enlarged sectional view taken along line 16—16 of FIG. 6.
Figure 17:
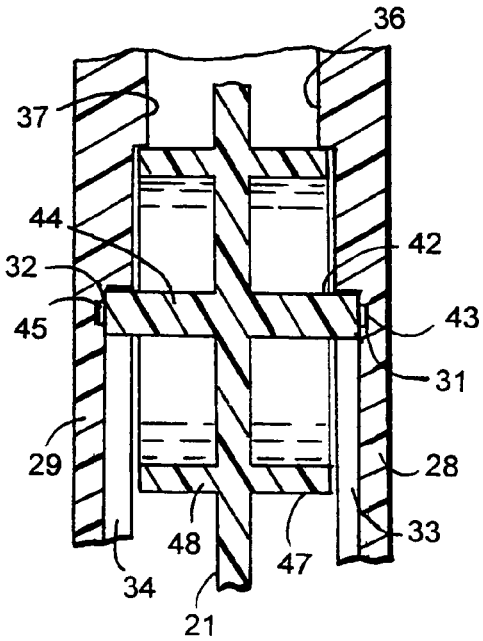
FIG. 17 is an enlarged sectional view similar to FIG. 16 showing the releasable locking relationship between the cutting wheel and handle.

A modification of the cutting wheel, indicated at 121, shown in FIGS. 14 and 15, has a hub 141 carrying a disc shaped blade, such as a stainless steel metal blade, with a cutting edge 146. Hub 141 has a pair of outwardly extending annular collars 147 and 148. Collars 147 and 148 surround axles 142 and 144 in concentric relation extending from the center of hub 141 in opposite directions. The outer ends of axles 142 and 144 are located distally relative to the outer ends of collars 147 and 148. Semi-circular convex shaped protrusions 143 and 145 on the outer ends of axles 142 and 144 are locatable in recesses 31 and 32 with a snug friction fit relation.

In use, handle 22 is gripped by the user's hand with the thumb and fingers on opposite sides of handle 22 whereby the user's hand is located directly above the cutting area. Top wall 24 comfortably fits in the palm of the user's hand. Downward pressure exerted on top wall 24 moves cutting edge 46 downward through pizza 23. Moving cutter 20 across pizza 23, as shown by arrow 25 in FIG. 1, while maintaining downward pressure causes cutting wheel 21 to rotate and cut pizza 23. The pressure exerted on cutting wheel 21 is distributed evenly between axles 42 and 44 and collars 47 and 48 which engage complementary shaped bearing surfaces of grooves 33 and 34 and shoulders 37 and 38 thereby maintaining alignment of cutting wheel 21 and handle 22 even when cutter 20 is subjected to twisting movement. Cutting wheel 21 can be separated from handle 21 for cleaning by pulling handle 22 and cutting wheel 21 in opposite directions thereby moving protrusions 43 and 45 out of recess 31 and 32. This causes side walls 26 and 27 to slightly flex outwardly whereby cutting wheel 21 can be removed from handle 22.

The present disclosure are preferred embodiments of the cutter. It is understood that the cutter is not to be limited to the specific materials, constructions, arrangements shown and described. It is understood that changes in parts, materials, arrangement and locations of structures may be made without departing from the invention.

The invention claimed is:

1. A disc cutter comprising: a housing, a cutter disc rotatably mounted in the housing, the disc having outwardly extending axles joined to opposite sides of the disc, each axle having an outwardly directed outer end, the disc extending through a slot in the bottom of the housing, the housing having resiliently flexible side walls joined to a semi-circular top surface to allow moving apart of the side walls and separation of the disc from the housing, each side wall having an inside surface with a longitudinal groove open to the bottom of the side wall, each groove having a downwardly directed bearing surface slidably engaging the axles, the upper end of each groove having a recess radially spaced from the downwardly directed bearing surface, the recesses accommodating the outer ends of the axles in a friction fit relationship, the disc having collar means surrounding each axle concentric with the axle, the collar means having an outer radial surface, the housing having a downwardly directed arcuate shoulder slidably engaging the radial surface.

2. The cutter of claim 1 wherein: the collar means has an outer transverse surface spaced inwardly from the outer end of the axle.

3. The cutter of claim 1 wherein: the outer end of each axle has an outwardly directed protrusion accommodated by the recess, the protrusion having a shape complimentary to the shape of the recess.

4. A pizza cutter comprising: a hollow one-piece semi-circular shaped handle member having a pair of resiliently flexible semi-circular shaped side walls joined to a top wall, a cutting wheel rotatably mounted in the handle member between the side walls and extending through a slot in the bottom of the handle member, the cutting wheel having a hub member having outwardly extending axles joined to opposite sides of the cutting wheel, the outer end of each axle having an outwardly directed convex curved protrusion, each side wall having an inside surface with a longitudinal groove open to the bottom of the side wall, the groove having an outwardly directed concave curved recess accommodating the protrusion in a friction fit relationship, the hub member having oppositely extending axle members, each axle member having an axis concentric with the axis of the outwardly extending axle, the inside surface of each side wall having a first arcuate bearing surface and a second bearing surface generally parallel to the first bearing surface, the axle slidably engaging the first bearing surface, the axle member slidably engaging the second bearing surface.

5. The pizza cutter of claim 4 wherein: each axle member has outer ends spaced inwardly from the outer ends of the axel.

6. A pizza cutter comprising: a hollow one-piece semi-circular shaped handle member having a pair of resiliently flexible side walls joined to a concave curved top wall and an open bottom, a cutting wheel removably mounted in the handle member between the side walls and extending through the open bottom of the handle member, the cutting wheel having a hub member, the hub member having a first axle member and a second axle member rotatably engaging first and second downwardly directed bearing surfaces on the inside surfaces of the side walls to rotatably mount the cutting wheel on the handle member, the first and second bearing surfaces being parallel arcuate surfaces, the first axle member having oppositely directed outer ends, each outer end having an outwardly directed protrusion, each side wall having a downwardly directed ear extending from the bottom edge of the side wall, the ear having an inside surface, the inside surface of the ear having a recess radially spaced from the first and second bearing surfaces, the recess accommodating the protrusion in a friction fit relationship.

7. The pizza cutter of claim 6 wherein: the first axle member has an axis concentric with the axis of the second axle member.

8. The pizza cutter of claim 6 wherein: the second axle member has outer ends spaced inwardly from the outer ends of the first axle member.

* * * * *